US008051512B2

(12) United States Patent
Teeter

(10) Patent No.: US 8,051,512 B2
(45) Date of Patent: Nov. 8, 2011

(54) PATIENT TREATMENT APPARATUS

(76) Inventor: Roger C. Teeter, Summer, WA (US)

( * ) Notice: Subject to any disclaimer, the term of this patent is extended or adjusted under 35 U.S.C. 154(b) by 260 days.

(21) Appl. No.: 12/460,189

(22) Filed: Jul. 15, 2009

(65) Prior Publication Data

US 2011/0010859 A1 Jan. 20, 2011

(51) Int. Cl.
*A47B 7/02* (2006.01)

(52) U.S. Cl. ..... 5/618; 5/611; 297/344.17

(58) Field of Classification Search ..... 5/607, 611–614, 5/616–618, 620, 625, 627, 110–112, 114; 297/354.1, 354.13, 377, 450.1, 344.12, 344.15, 297/344.17–344.2; 108/106, 108; 280/650, 280/250.1

See application file for complete search history.

(56) References Cited

U.S. PATENT DOCUMENTS

| | | | | |
|---|---|---|---|---|
| 4,144,880 | A | 3/1979 | Daniels | 128/71 |
| 4,751,754 | A * | 6/1988 | Bailey et al. | 5/611 |
| 4,913,424 | A | 4/1990 | Pepin | 272/144 |
| 4,915,101 | A | 4/1990 | Cuccia | 128/73 |
| 5,342,114 | A * | 8/1994 | Burke et al. | 297/344.2 |
| 5,794,286 | A | 8/1998 | Scott et al. | 5/611 |
| 6,089,593 | A * | 7/2000 | Hanson et al. | 280/650 |
| 6,637,055 | B1 | 10/2003 | Nanan | 5/610 |

* cited by examiner

*Primary Examiner* — Robert G Santos
*Assistant Examiner* — Nicholas Polito
(74) *Attorney, Agent, or Firm* — Charles E. Baxley

(57) ABSTRACT

A patient treatment device includes a patient supporting table supported above a platform and having an auxiliary table segment pivotally coupled to a primary table segment, and a back support segment pivotally coupled to the primary table segment, an anchor assembly adjustably anchors the auxiliary table segment to the primary table segment at selected angular positions, and an anchoring mechanism adjustably anchors the back support segment to the auxiliary table segment at required angular positions. A frame is pivotally coupled to the primary table segment, and a latch mechanism adjustably anchors the frame to the primary table segment at the required angular positions.

16 Claims, 18 Drawing Sheets

PATIENT TREATMENT APPARATUS

BACKGROUND OF THE INVENTION

1. Field of the Invention

The present invention relates to a patient treatment apparatus, and more particularly to a patient treatment apparatus including a stable support for stably elevating the patient supporting table and for allowing the patient supporting table to be tilted or inclined relative to the supporting base to suitably support the head or upper portion and the leg or lower portion of the patient tiltedly or inclinedly relative to the patient supporting table.

2. Description of the Prior Art

Typical patient treatment apparatuses comprise a patient supporting table for supporting the patient thereon and a control mechanism for applying controlled flexion and traction to a patient's body.

For example, U.S. Pat. No. 4,144,880 to Daniels discloses one of the typical orthopedic tables comprising a patient supporting table including harnessed opposite ends, and a pelvic straps on the lower platform secure the patient's pelvic region to the lower platform.

However, the patient supporting table may not be elevated relative to the supporting base, and a complicated tilting mechanism is provided to tilt or incline the patient supporting table relative to the supporting base.

U.S. Pat. No. 4,913,424 to Pepin discloses another typical slant board with automatic foot release and comprising a patient supporting table rotatable upon a horizontal axis from a horizontal position to a near vertical position.

However, similarly, the patient supporting table also may not be elevated relative to the supporting base such that the patient may not be suitably lowered or elevated relative to the supporting base to the required height.

U.S. Pat. No. 4,915,101 to Cuccia discloses a further typical rotatable treatment table including a weighted platform adapted to rest upon a floor, and rigid support elements pivotally attached or supported on the weighted platform and rotatable relative to the weighted platform with an extensible elevation member.

However, similarly, the rigid support elements also may not be elevated relative to the weighted platform such that the patient may not be suitably lowered or elevated relative to the weighted platform to the required height.

U.S. Pat. No. 5,794,286 to Scott et al. discloses a still further typical patient treatment apparatus including an elongated table pivotally attached or supported on a bottom or base with a pivotal table support column and rotatable relative to the base with a pusher block assembly.

However, the pusher block assembly include a weak structure that may not stably support the elongated table on the pivotal table support column and the elongated table and the patient supported on the elongated table may have a good chance to be tilted or inclined relative to the supporting base, and a complicated tilting mechanism is provided to tilt or incline the elongated table relative to the supporting base.

U.S. Pat. No. 6,637,055 to Nanan discloses a still further yoga inversion bed with leg attachment and pivotable from a horizontal arrangement to a vertical arrangement to controllably support and invert a human body from a supine position to an inverted position.

However, the patient supporting table also may not be elevated relative to the supporting base such that the patient may not be suitably lowered or elevated relative to the supporting base to the required height.

The present invention has arisen to mitigate and/or obviate the afore-described disadvantages of the conventional patient treatment apparatuses.

SUMMARY OF THE INVENTION

The primary objective of the present invention is to provide a patient treatment apparatus including a stable support for stably elevating the patient supporting table and for allowing the patient supporting table to be tilted or inclined relative to the supporting base to suitably support the head or upper portion and the leg or lower portion of the patient tiltedly or inclinedly relative to the patient supporting table.

In accordance with one aspect of the invention, there is provided a patient treatment apparatus comprising a platform, a patient supporting table supported above the platform and including a primary table segment, an auxiliary table segment pivotally coupled to the primary table segment for allowing the auxiliary table segment to be pivoted and rotated relative to the primary table segment, and a back support segment pivotally coupled to the primary table segment and to be located above the auxiliary table segment, an anchor assembly disposed between the primary table segment and the auxiliary table segment to adjustably and selectively anchor and position the auxiliary table segment to the primary table segment at a selected angular position, and an anchoring mechanism disposed between the back support segment and the auxiliary table segment to adjustably and selectively anchor and position the back support segment to the auxiliary table segment at the required angular positions.

The anchor assembly includes an anchor rod pivotally attached to the primary table segment, and an anchor member pivotally coupled to the auxiliary table segment and engaged with the anchor rod for adjustably anchoring and positioning the auxiliary table segment to the primary table segment at the selected angular position.

The anchor member includes an anchoring hole formed therein for slidably receiving and engaging with the anchor rod and for adjustably anchoring and positioning the auxiliary table segment to the primary table segment when the anchor rod is tilted relative to the anchor member.

The anchor assembly includes an actuating member pivotally attached to the auxiliary table segment for selectively engaging with the anchor member and for disengaging the anchor rod from the anchor member and for allowing the auxiliary table segment to be pivoted relative to the primary table segment to the selected angular position.

The actuating member is pivotally attached to the auxiliary table segment with a shaft, and a hand grip is extended from the shaft for rotating the shaft relative to the auxiliary table segment. The anchor assembly includes a spring member coupled between the anchor member and the auxiliary table segment for biasing and tilting the anchor member relative to the anchor rod and for adjustably anchoring the auxiliary table segment to the primary table segment at the selected angular position.

The anchoring mechanism includes an anchor stick pivotally coupled to the back support segment, and an anchoring element pivotally coupled to the auxiliary table segment and engaged with the anchor stick for adjustably anchoring and positioning the back support segment to the auxiliary table segment.

The anchoring element is pivotally attached to the auxiliary table segment with a pivot spindle and includes an aperture formed in the anchoring element for receiving and engaging with the anchor stick.

The pivot spindle includes a threading element for engaging with the anchoring element and for selectively engaging with the anchor stick and for selectively securing the anchor stick to the anchoring element.

The patient supporting table includes a frame pivotally coupled to the primary table segment, and a latch mechanism coupled between the frame and the primary table segment to adjustably anchor and position the frame to the primary table segment at a required angular position.

The latch mechanism includes an anchor pole pivotally coupled to the primary table segment, and a latch device pivotally coupled to the frame and engaged with the anchor pole for adjustably anchoring and positioning the frame to the primary table segment at the required angular position.

The latch device includes an arm, and an orifice formed in the arm for slidably receiving and engaging with the anchor pole, and a handle extended from the latch device for tilting the arm of the latch device relative to the anchor pole.

The latch mechanism includes a spring member coupled between the frame and the latch device for biasing and tilting the latch device relative to the anchor pole.

The platform includes an upper cantilever member and a lower cantilever member pivotally attached and coupled to the platform with pivot poles, and a bracket pivotally attached and coupled to the upper and the lower cantilever members with pivot axles respectively for allowing the upper and the lower cantilever members and the bracket to be formed as a parallelogrammic device and for allowing the upper and the lower cantilever members to be pivoted up and down relative to the platform with the pivot poles, and an elevating transmission device including a tube, and a motor-driven rod slidably received and engaged in the tube and coupled between the platform and the parallelogrammic device for pivoting the upper and the lower cantilever members up and down relative to the platform.

The elevating transmission device includes a seat having a lower portion pivotally attached and coupled to the platform with a pivot pin, and the tube is extended upwardly from the seat and the rod is slidably received and engaged in the tube and coupled to the parallelogrammic device.

The parallelogrammic device includes a lateral bar attached to the upper cantilever member for supporting the pivot pin, and the lateral bar includes an upwardly bent structure for supporting the pivot pin above the upper cantilever member.

The parallelogrammic device includes a tilting transmission device having a tube, and a motor-driven rod slidably received and engaged in the tube and coupled between the patient supporting table and the parallelogrammic device for tilting the patient supporting table between a horizontal position and a tilted working position.

The tilting transmission device includes a seat having a lower portion pivotally attached and coupled to the bracket with a pivot pin, and the tube is extended upwardly from the seat and the rod is slidably received and engaged in the tube and coupled to the patient supporting table.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
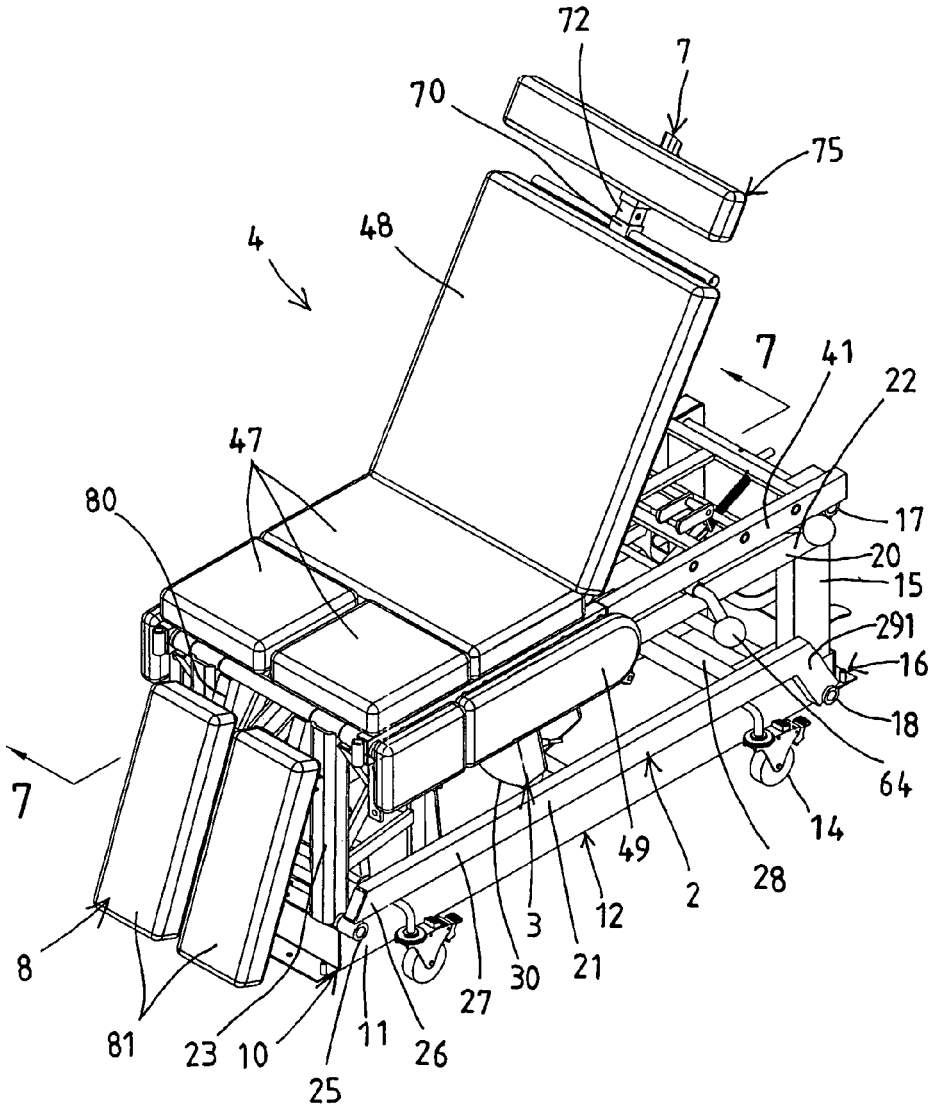
FIG. 1 is a perspective view of a patient treatment apparatus in accordance with the present invention.
Figure 2:
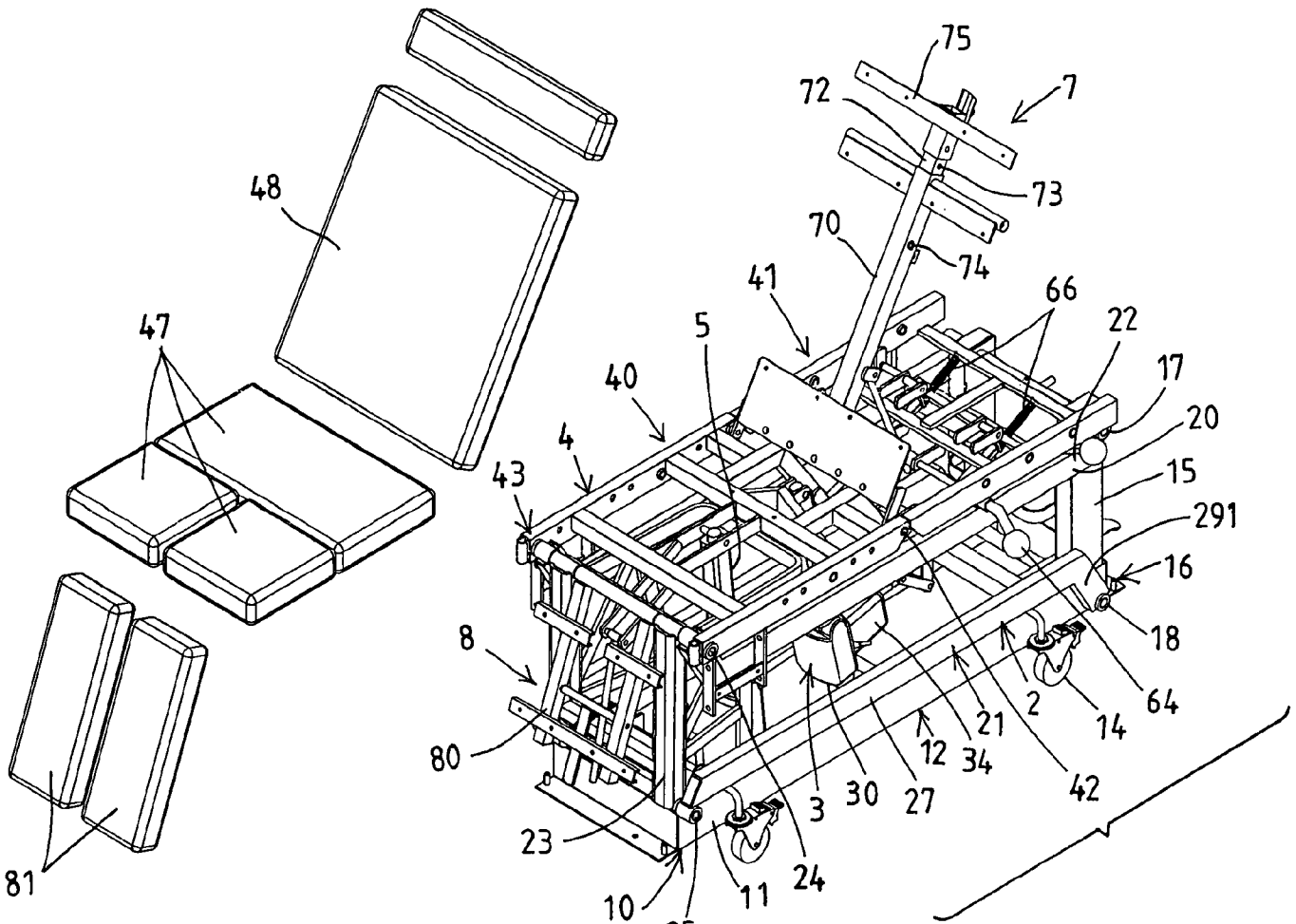
FIG. 2 is a partial exploded view of the patient treatment apparatus.
Figure 3:
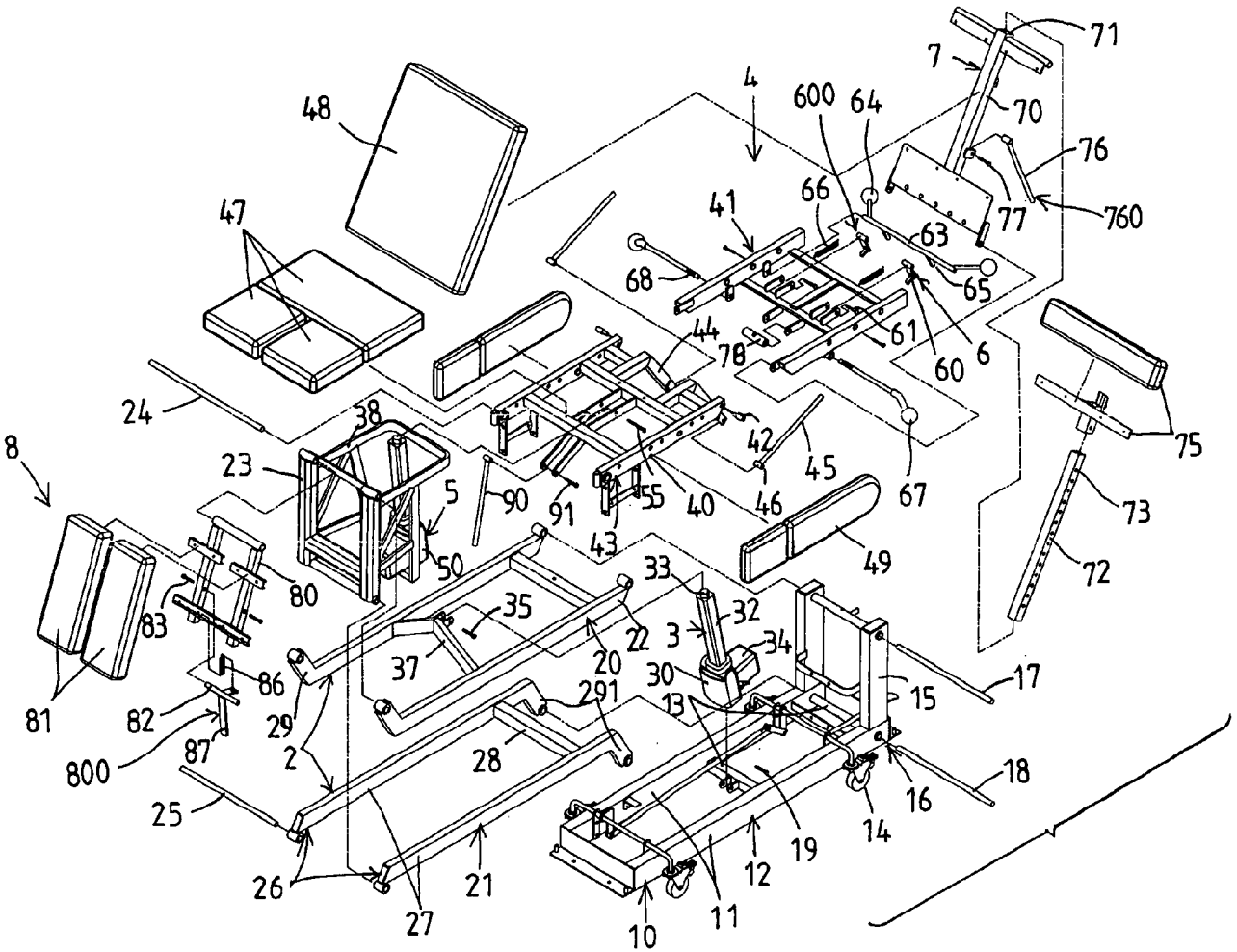
FIG. 3 is another partial exploded view of the patient treatment apparatus.
Figure 4:
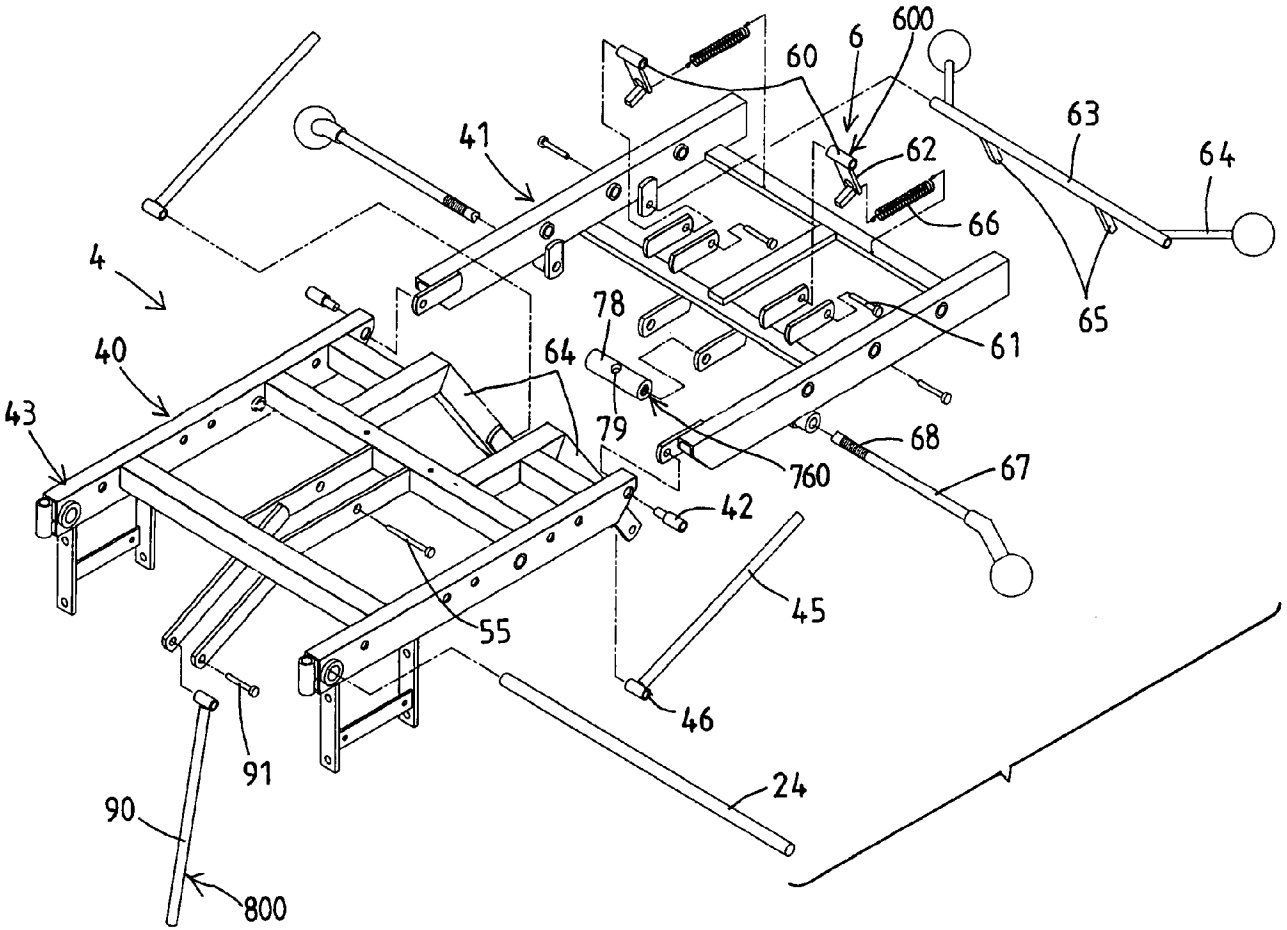
FIGS. 4, 5, 6 are further enlarged partial exploded views of the patient treatment apparatus.
Figure 5:
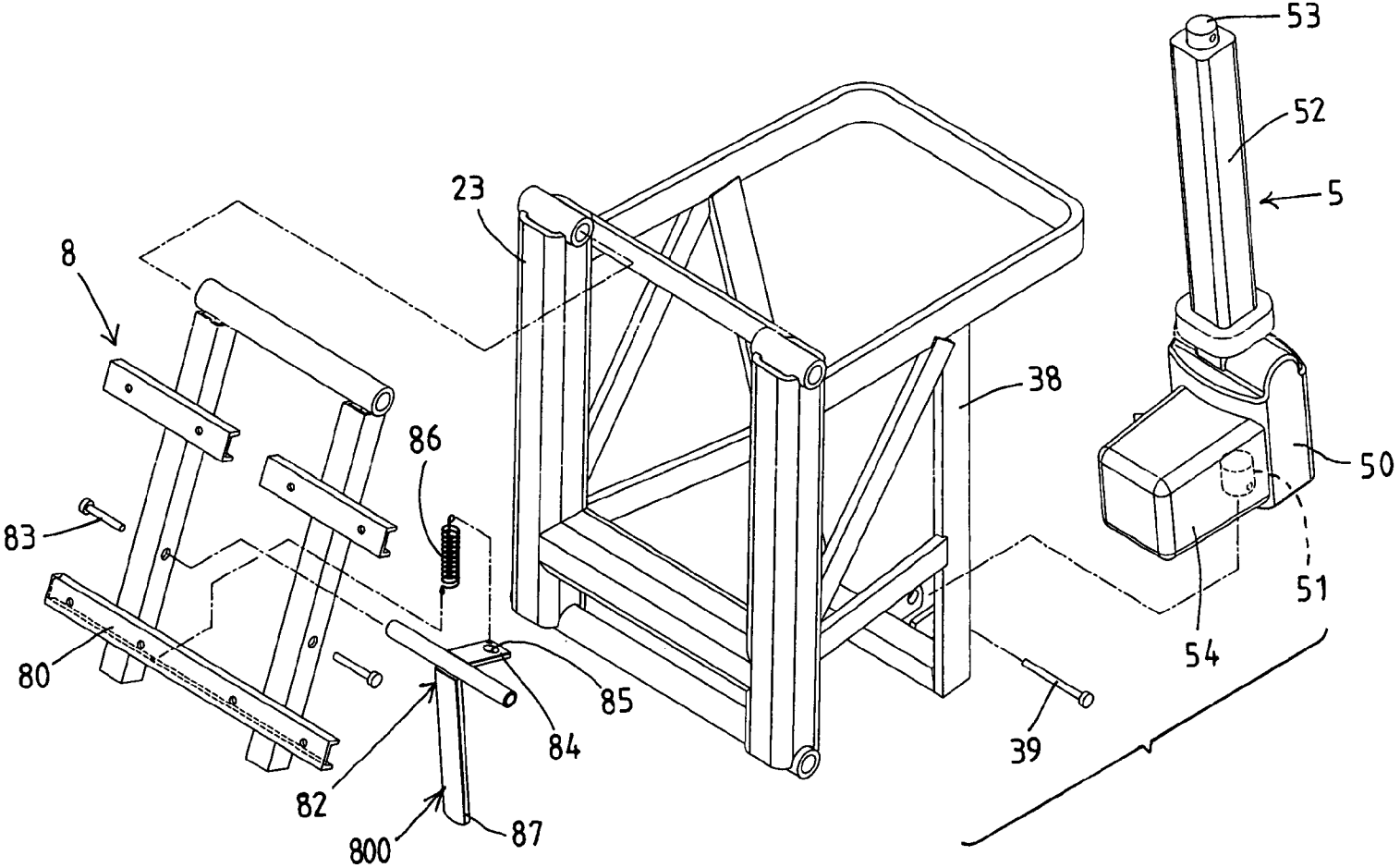
Figure 6:
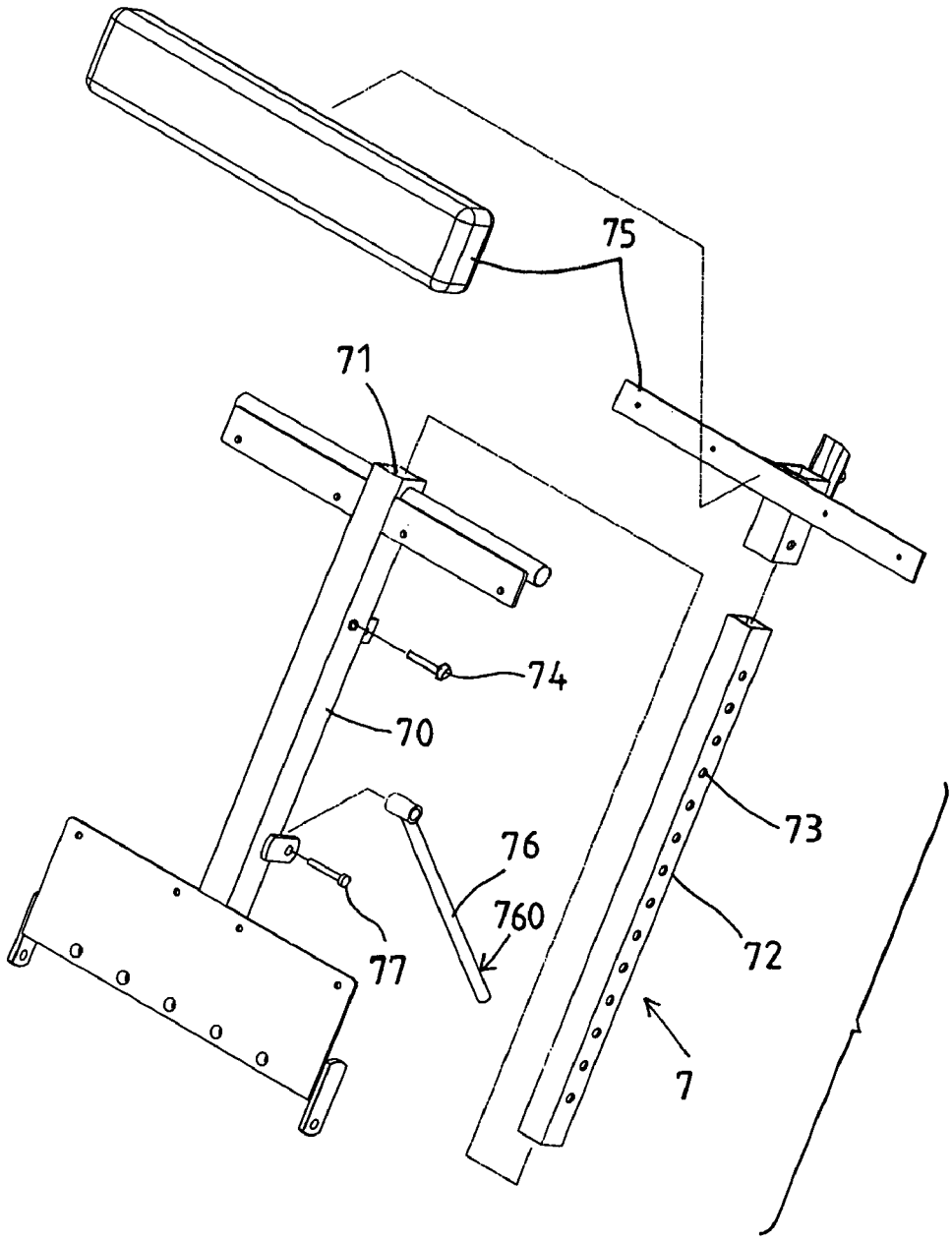
Figure 7:
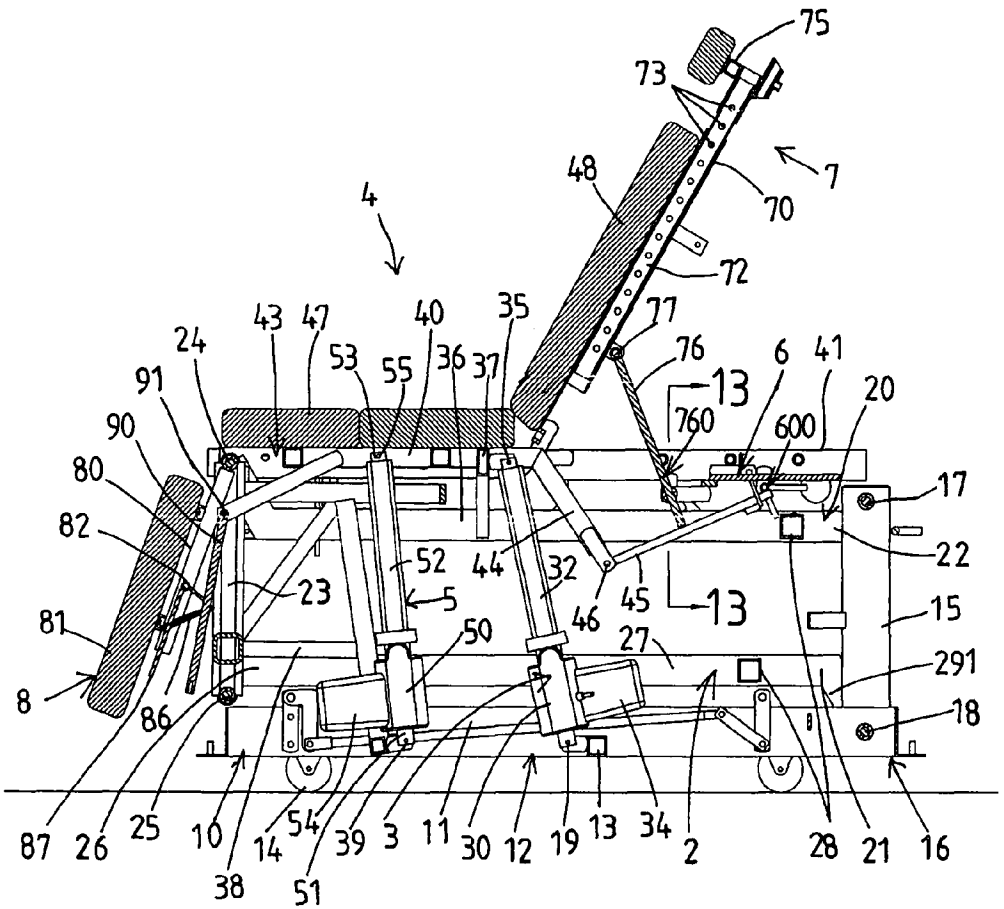
FIG. 7 is a partial cross sectional view of the patient treatment apparatus taken along lines 7-7 of FIG. 1.
Figure 8:
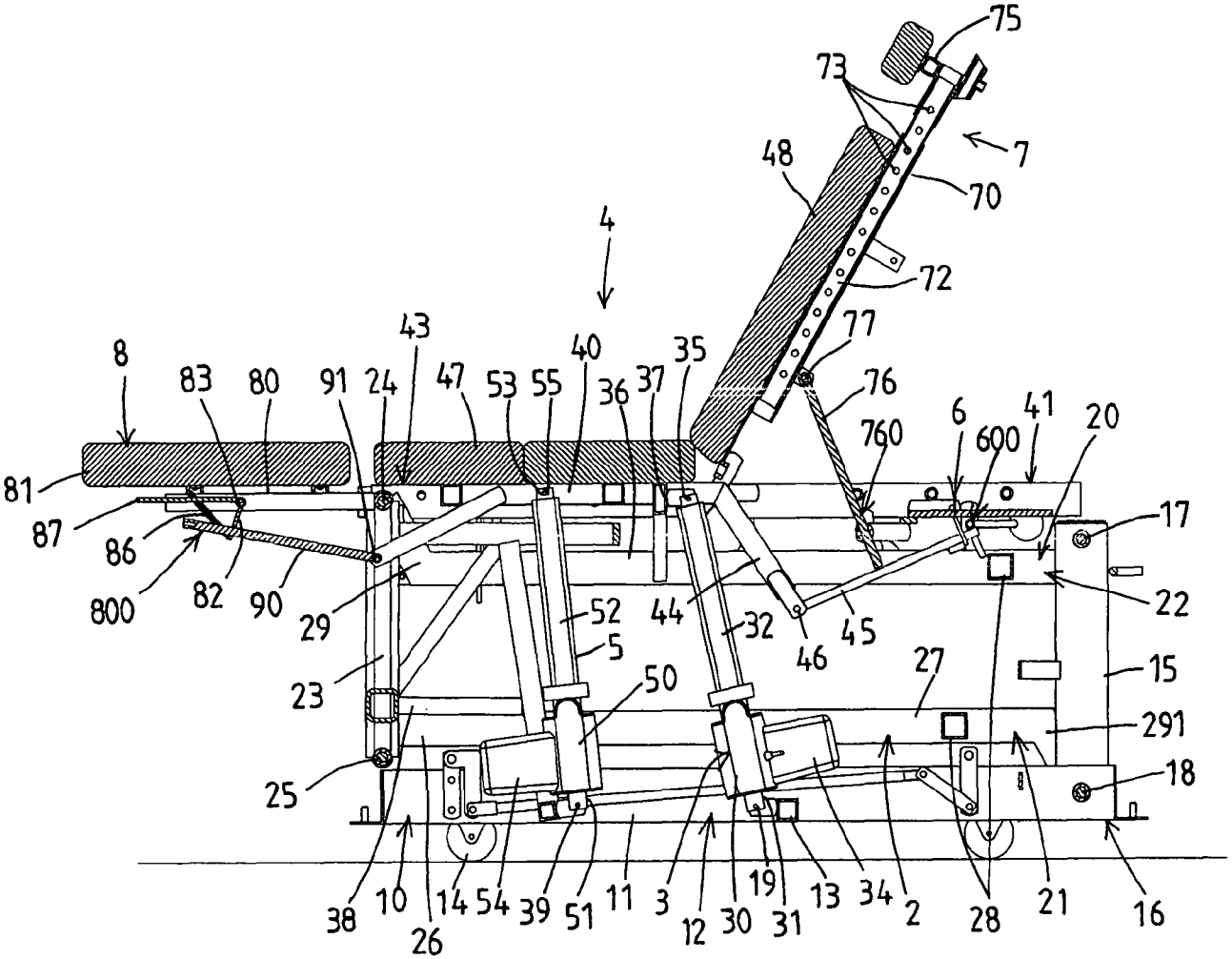
FIGS. 8, 9, 10, 11, 12 are partial cross sectional views similar to FIG. 7, illustrating the operation of the patient treatment apparatus.
Figure 9:
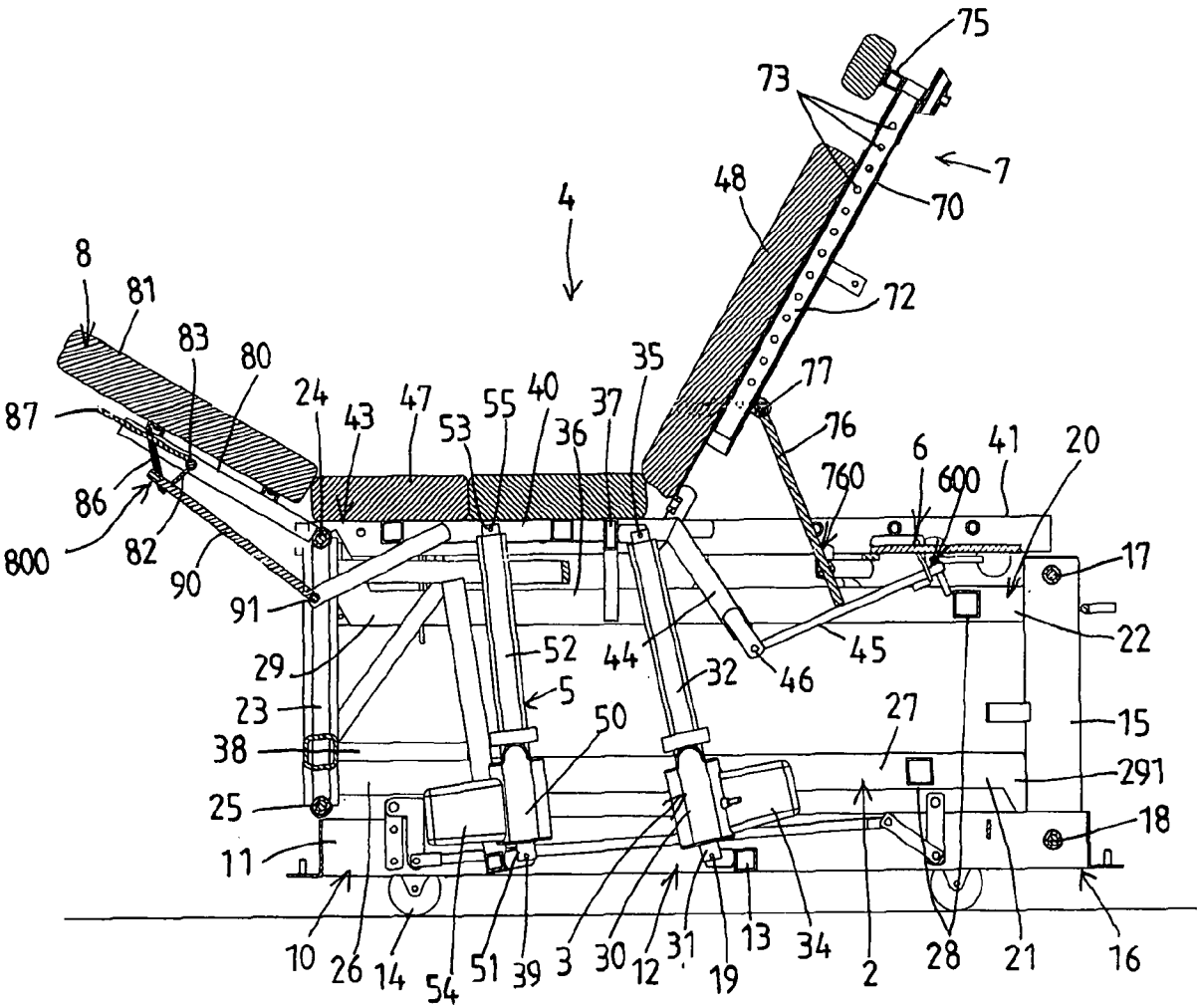

Referring to the drawings, and initially to FIGS. 1-7, a patient treatment apparatus in accordance with the present invention comprises a weighted platform 10 adapted to rest upon a floor and including two side beams 11, and one or more lateral bars 13 coupled between the side beams 11 for securing the side beams 11, together and to form a substantially rectangular structure, one or more wheel devices or wheel members 14 may be attached to the bottom of the platform 10 for allowing the platform 10 to be easily moved everywhere, and each may include a lock device (not shown) for locking the wheel members 14 and for preventing the platform 10 from being moved elsewhere when required.

The platform 10 may further include a column 15 extended upwardly therefrom, such as extended upwardly from the front portion 16 of the platform 10, and may further include two pivot poles 17, 18 attached thereto, such as attached to the front portion 16 of the platform 10, and such as attached to the column 15 and arranged one 17 above the other 18, and may further include a pivot pin 19 attached thereto, such as attached to the middle portion 12 or one of the lateral bars 13 of the platform 10. An upper cantilever member 20 and a lower cantilever member 21 are pivotally or rotatably attached or coupled to the platform 10, such as attached or coupled to the column 15 of the platform 10 with the pivot poles 17, 18.

For example, the upper cantilever member 20 and the lower cantilever member 21 each include one end or first end or front end 22 pivotally or rotatably attached or coupled to the platform 10, such as attached to the column 15 or the front portion 16 of the platform 10 with the pivot poles 17, 18 respectively, and a bracket 23 pivotally or rotatably attached or coupled to the other end or second end or rear portion 26 of the cantilever members 20, 21 with pivot axles 24, 25 respectively for allowing the cantilever members 20, 21 and the bracket 23 and the column 15 or the front portion 16 of the platform 10 to be formed as a parallelogrammic structure or configuration or device 2 and for allowing the cantilever members 20, 21 to be pivoted or rotated up and down relative to the platform 10 with the pivot poles 17, 18.

The cantilever members 20, 21 each may also include two side beams 27, and one or more lateral bars 28 coupled between the side beams 27 for securing the side beams 27, together and to form a substantially rectangular structure (FIGS. 7-9, 10-12), and the upper cantilever member 20 may include a bent end or rear segment 29 formed on the rear portion 26 of each of the side beams 27, and the lower cantilever member 21 may include a bent front segment 291 formed on the front end 22 of each of the side beams 27 and arranged for allowing the bracket 23 to be suitably parallel to the front column 15 of the platform 10 when the cantilever members 20, 21 are pivoted or rotated up and down relative to the platform 10 with the pivot poles 17, 18.

An elevating transmission device 3 includes a seat 30 having a lower portion 31 pivotally or rotatably attached or coupled to the platform 10, such as attached to the middle portion 12 or one of the lateral bars 13 of the platform 10 with the pivot pin 19, and includes a tube 32 extended upwardly from the seat 30, and a slidable rod 33 slidably received or engaged in the tube 32, and a motor 34 attached or mounted to the seat 30 and coupled to the slidable rod 33 for driving or moving the slidable rod 33 into and out of the tube 32, and the slidable rod 33 is pivotally or rotatably attached or coupled to the parallelogrammic device 2, such as attached to the upper cantilever member 20 for allowing the upper cantilever member 20 of the parallelogrammic device 2 to be elevated or pivoted or rotated up and down relative to the platform 10 by the motor 34 of the elevating transmission device 3.

Figure 10:
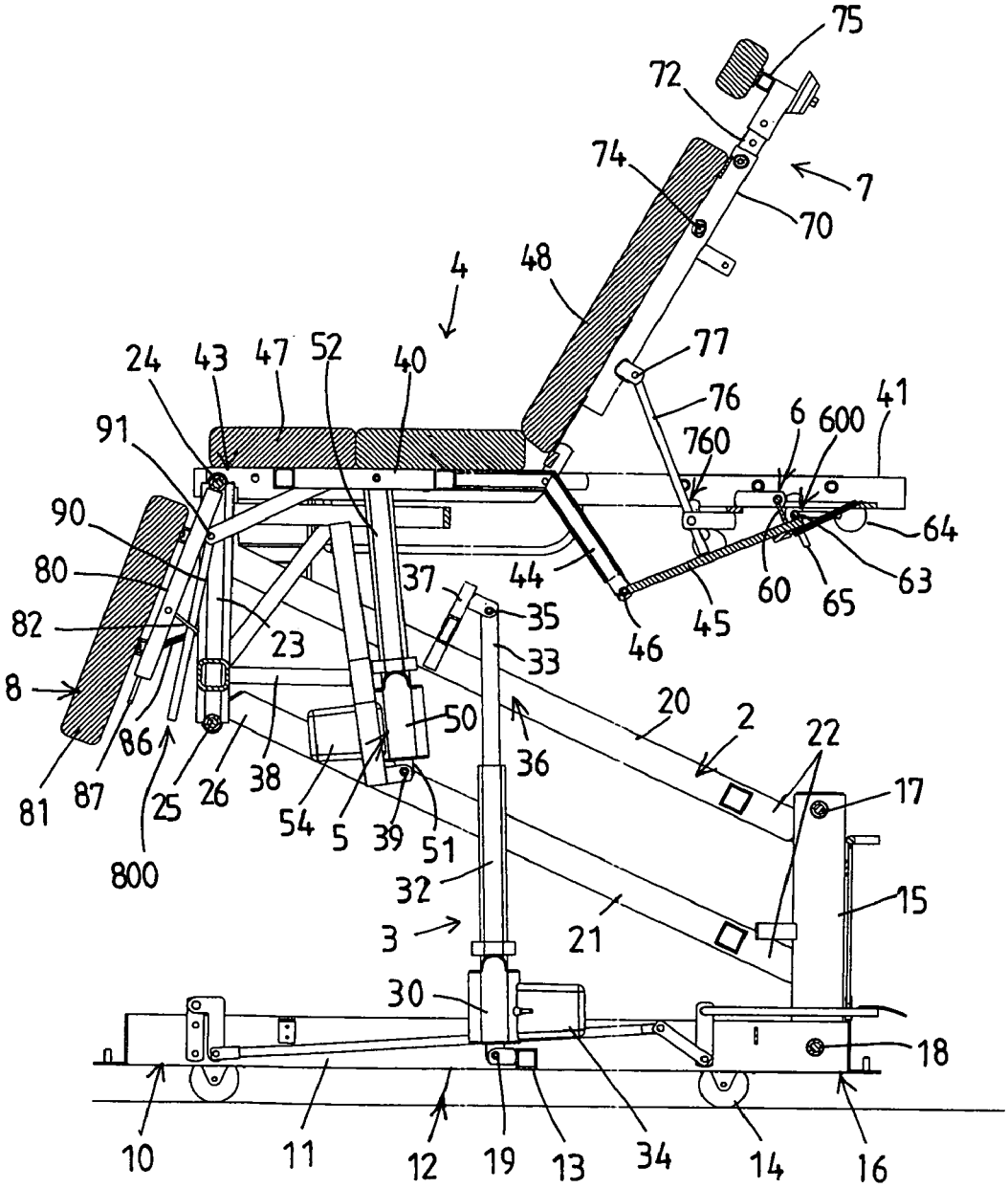
Figure 11:
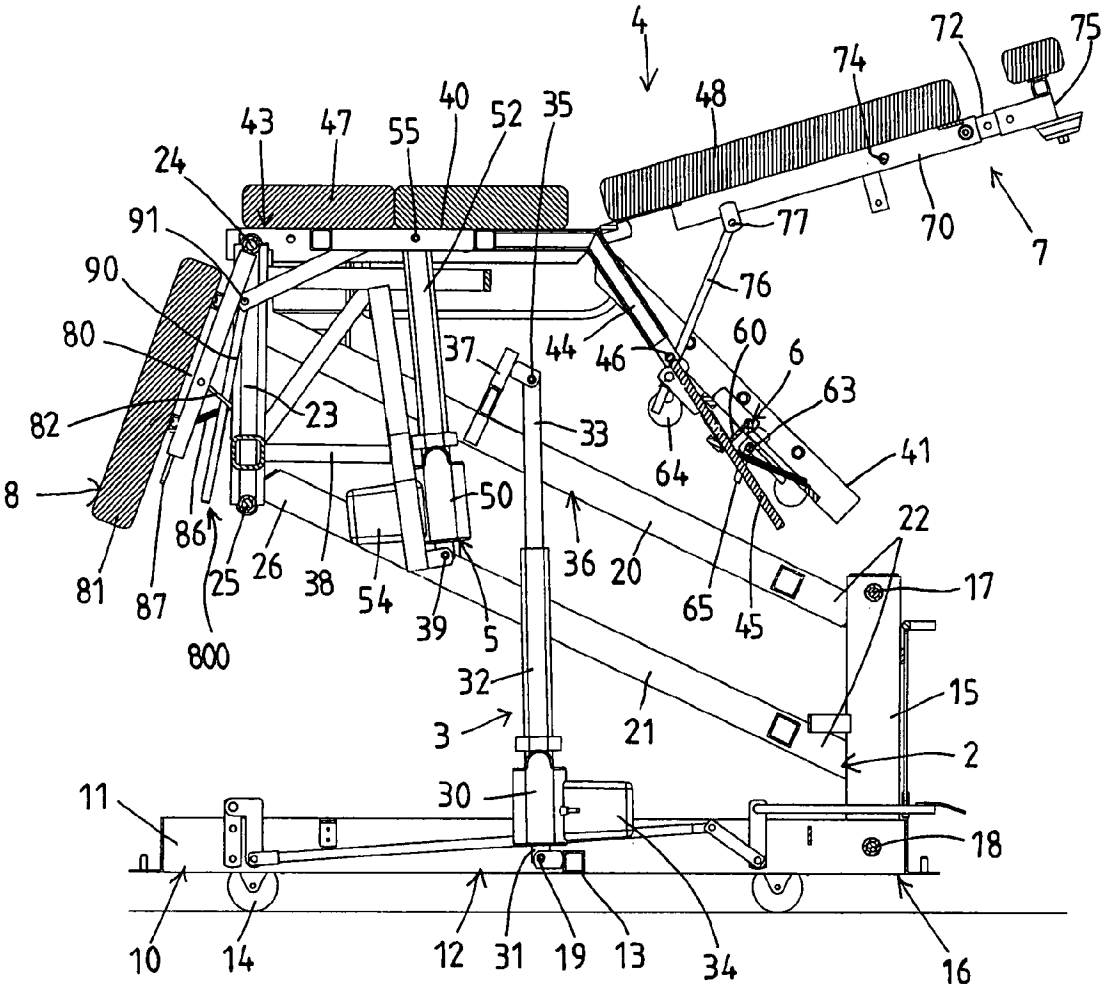
Figure 12:
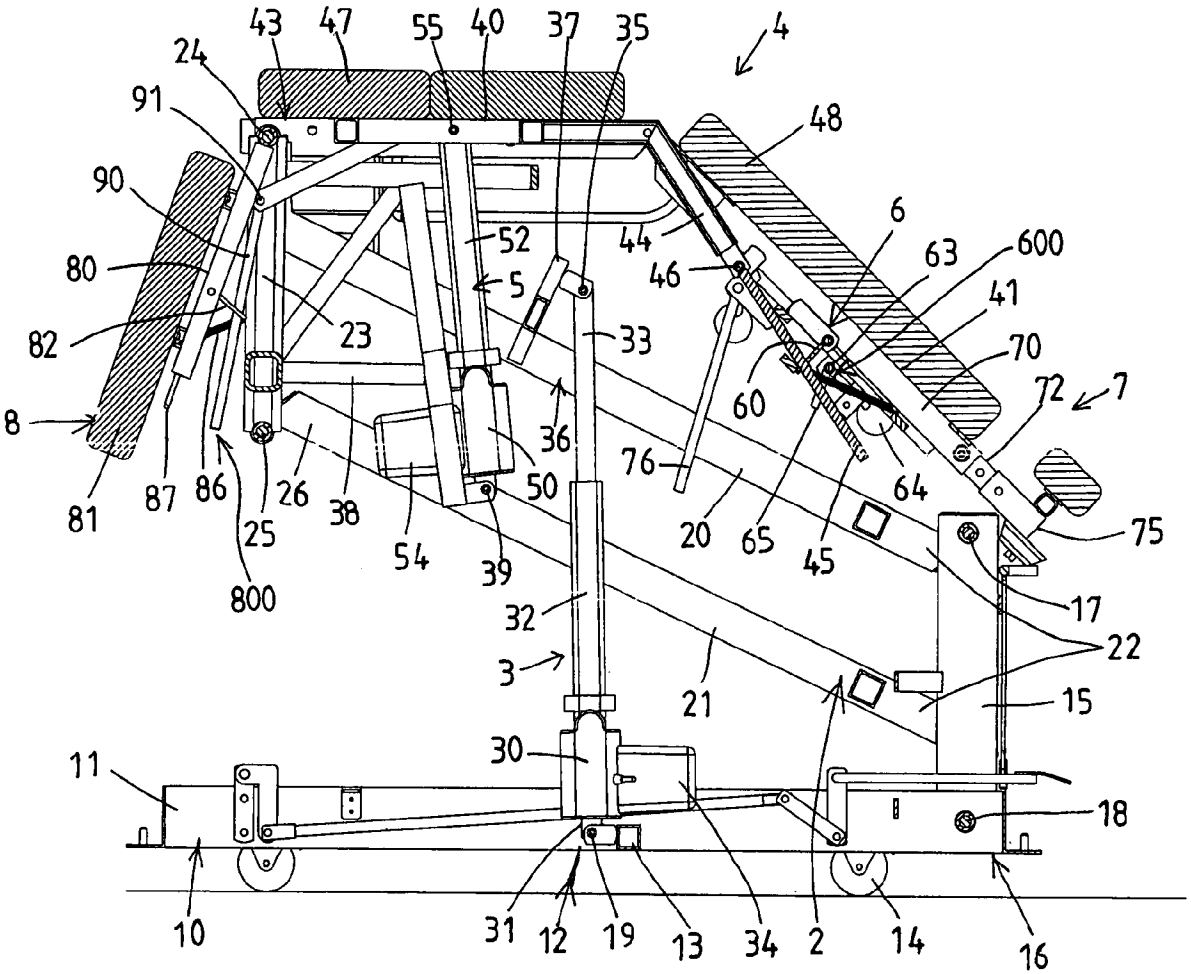
Figure 14:
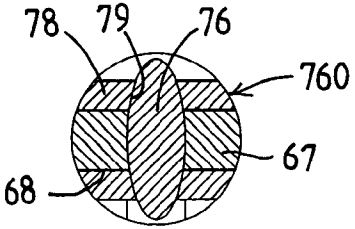
FIG. 14 is a further enlarged partial cross sectional view of the patient treatment apparatus as shown in FIG. 13.
Figure 13:
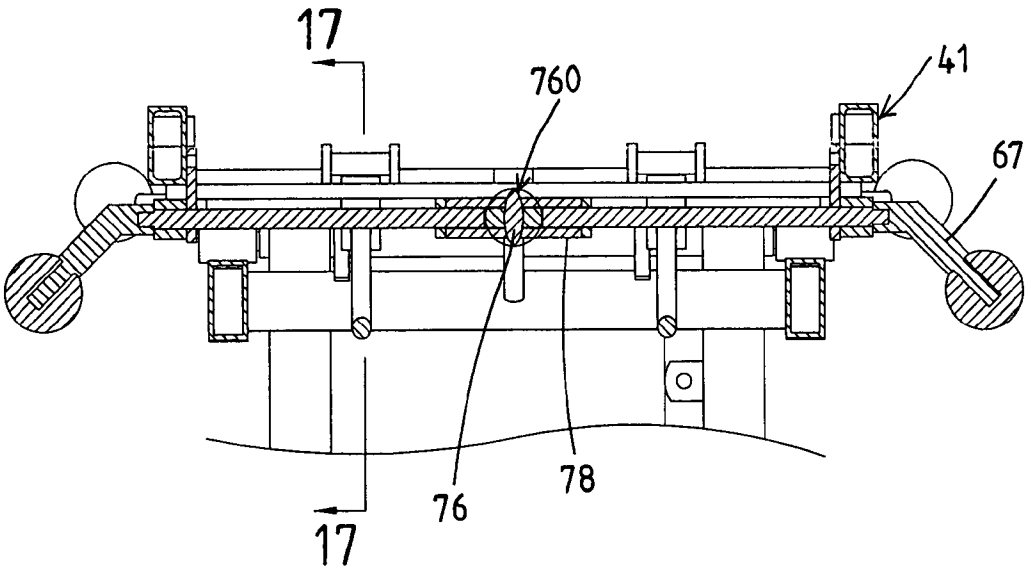
FIG. 13 is an enlarged partial cross sectional view of the patient treatment apparatus taken along lines 13-13 of FIG. 7.

The upper cantilever member 20 may include a pivot pin 35 attached thereto, such as attached to the middle portion 36 or one or the middle lateral bar 37 of the upper cantilever member 20, in which the middle lateral bar 37 includes an upwardly curved or bent structure for attaching the pivot pin 35 and arranged for allowing the pivot pin 35 to be located slightly above the upper cantilever member 20, best shown in FIGS. 10-12, the upper portion of the slidable rod 33 of the elevating transmission device 3 is pivotally or rotatably attached or coupled to the middle portion 36 or one of the lateral bars 37 of the upper cantilever member 20 of the parallelogrammic device 2 with the pivot pin 35 for allowing the upper cantilever member 20 of the parallelogrammic device 2 to be elevated or pivoted or rotated up and down relative to the platform 10 by the motor 34 of the elevating transmission device 3 between the lower rest position (FIGS. 1-2, and 7-9) and the upper working position (FIGS. 10-12).

The bracket 23 includes a framework 38 attached thereto, such as attached to the front or inner portion of the bracket 23, and includes another pivot pin 39 attached to the framework 38. A patient supporting table 4 includes one or more (such as two) table segments 40, 41 pivotally or rotatably coupled or secured together with pivot pins 42, and includes a rear portion 43 pivotally or rotatably attached or coupled to the bracket 23 of the parallelogrammic device 2 with the pivot axle 24 for allowing the patient supporting table 4 to be supported or disposed above the platform 10 and for allowing the patient supporting table 4 to be pivoted or rotated relative to the parallelogrammic device 2 between the lower rest or horizontal position (FIGS. 1-2, and 7-9) and the tilted or inclined working position (not shown).

A tilting transmission device 5 includes a seat 50 having a lower portion 51 pivotally or rotatably attached or coupled to the bracket 23, such as attached to the framework 38 of the bracket 23 with the pivot pin 39, and includes a tube 52 extended upwardly from the seat 50, and a rod 53 slidably received or engaged in the tube 52, and a motor 54 attached or mounted to the seat 50 and coupled to the rod 53 for driving or moving the rod 53 into and out of the tube 52, and the rod 53 is pivotally or rotatably attached or coupled to the patient supporting table 4, such as attached to one of the table segments or the primary table segment 40 of the patient supporting table 4 with a pivot pin 55 for allowing the patient supporting table 4 to be tilted or inclined relative to the bracket 23 of the parallelogrammic device 2 by the motor 54 of the tilting transmission device 5, and between the lower rest or horizontal position (FIGS. 1-2, and 7-9) and the tilted or inclined working position.

The primary table segment 40 of the patient supporting table 4 may include one or more (such as two) extensions 44 extended forwardly and downwardly therefrom, and one or more (such as two) anchor rods 45 each include one end pivotally or rotatably attached or coupled to the extensions 44 of the primary table segment 40 with a pivot pin 46. As shown in FIGS. 3-4 and 17-20, an anchor device 6 includes one or more (such as two) anchor members 60 each pivotally or rotatably attached or coupled to the auxiliary table segment 41 with a pivot pin 61 and each having an anchoring hole 62 formed therein for slidably receiving or engaging with the anchor rod 45 and for adjustably anchoring or positioning the auxiliary table segment 41 to the primary table segment 40 at the required angular position when the anchor rods 45 are tilted or inclined relative to the anchor members 60 relatively (FIGS. 10-12, and 17-18). The anchor device 6 and the anchor rod 45 may be formed and may act as an anchoring assembly 600 and may be disposed between the primary table segment 40 and the auxiliary table segment 41 to adjustably anchor or position the auxiliary table segment 41 to the primary table segment 40 at the required angular position.

A shaft 63 is pivotally or rotatably attached or coupled to the auxiliary table segment 41 and includes one or more (such as two) hand grips 64 extended outwardly therefrom for rotating the shaft 63 relative to the auxiliary table segment 41, and includes one or more (such as two) actuating members 65 extended outwardly therefrom for selectively engaging with the anchor members 60 and for rotating the anchor members 60 relative to the anchor rods 45 respectively and for aligning the anchor rods 45 with the anchoring holes 62 of the anchor members 60 (FIGS. 19, 20) and for disengaging the anchor rods 45 from the anchor members 60, and thus for allowing the auxiliary table segment 41 to be pivoted or rotated relative to the primary table segment 40 to the required angular position.

The anchor rods 45 will be tilted or inclined relative to the anchor members 60 again to anchor or position the auxiliary table segment 41 to the primary table segment 40 at the required angular position when the hand grips 64 are released. One or more (such as two) spring members 66 may further be provided and coupled between the anchor members 60 and the auxiliary table segment 41 for biasing and forcing and tilting the anchor members 60 relative to the anchor rods 45, and thus for anchoring or positioning the auxiliary table segment 41 to the primary table segment 40 at the required angular position. For example, as shown in FIGS. 10-12, the auxiliary table segment 41 may be pivoted or rotated relative to the primary table segment 40 to the required angular position particularly when the primary table segment 40 of the patient supporting table 4 is pivoted or rotated or elevated up relative to the platform 10 by the elevating transmission device 3.

The patient supporting table 4 may further include a back rest or support segment 7 which may also be pivotally or rotatably coupled or secured to the primary table segment 40 or the auxiliary table segment 41 with the pivot pins 42 and which may be located above the auxiliary table segment 41, and the back support segment 7 includes a tubular member 70 having a bore 71 formed therein, and a slidable rod 72 slidably received or engaged in the bore 71 or the tubular member 70 and having a number of orifices 73 for engaging with a lock pin or fastener 74 (FIGS. 2, 6, 10- 11) and for adjustably anchoring or positioning or securing the slidable rod 72 relative to the tubular member 70 to the required extending position. A head rest 75 may be attached to the slidable rod 72 for supporting the head portion of the user.

The back support segment 7 includes an anchor stick 76 pivotally or rotatably coupled thereto with a pivot pin 77, and a barrel or anchoring element 78 is pivotally or rotatably coupled or secured to the auxiliary table segment 41 with one or more (such as two) pivot spindles 67 which may include a threading element 68 for threading or engaging with the anchoring element 78 and for pivotally or rotatably coupling or securing the anchoring element 78 to the auxiliary table segment 41. The anchoring element 78 includes an aperture 79 formed therein (FIG. 4) for receiving or engaging with the anchor stick 76 (FIGS. 7-9 and 13-16) and for adjustably anchoring or positioning the back support segment 7 to the auxiliary table segment 41 at the required angular position. The anchoring element 78 and the anchor stick 76 may be formed and may act as an anchoring mechanism 760 and may be disposed between the back support segment 7 and the auxiliary table segment 41 to adjustably anchor or position the back support segment 7 to the auxiliary table segment 41 at the required angular position.

Figure 16:
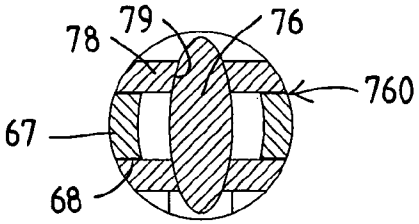
FIGS. 15, 16 are enlarged partial cross sectional views similar to FIGS. 13, 14 respectively, illustrating the operation of the patient treatment apparatus.
Figure 15:
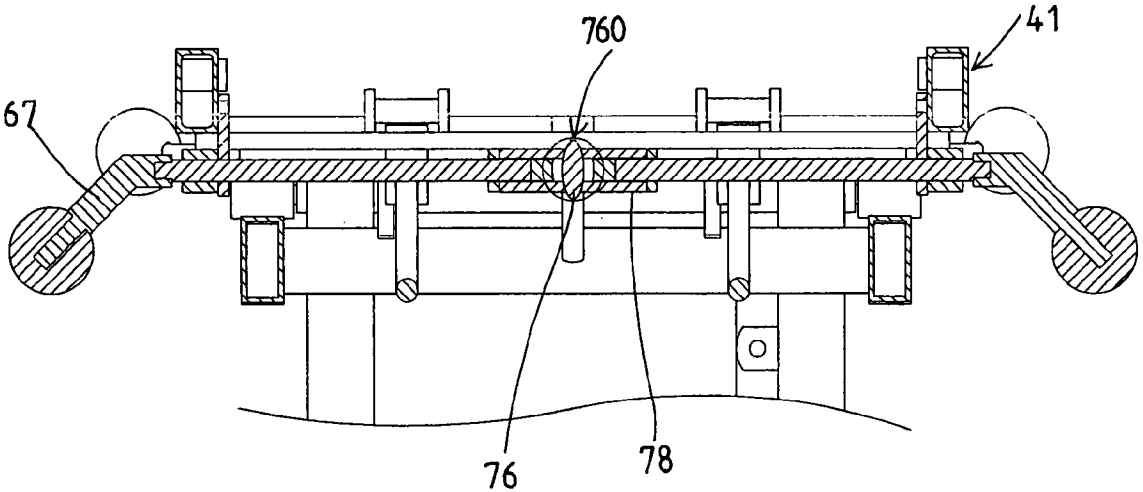
Figure 18:
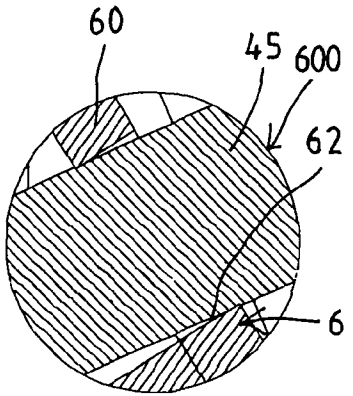
FIG. 18 is a still further enlarged partial cross sectional view of the patient treatment apparatus as shown in FIG. 17.
Figure 17:
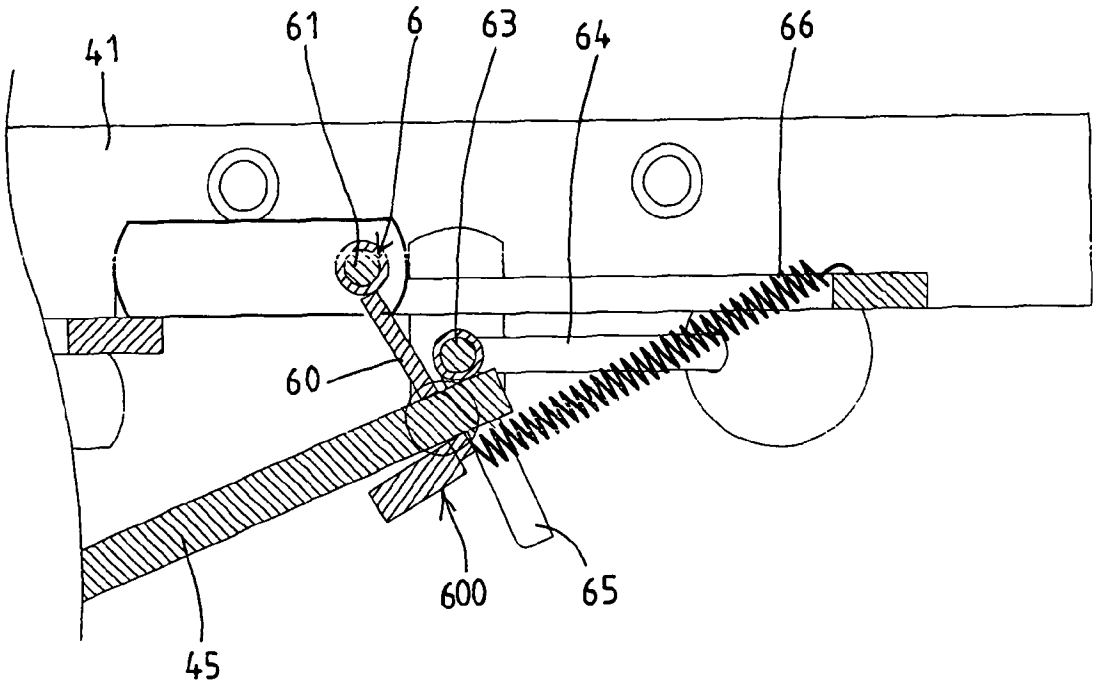
FIG. 17 is a still further enlarged partial cross sectional view of the patient treatment apparatus taken along lines 17-17 of FIG. 13.
Figure 20:
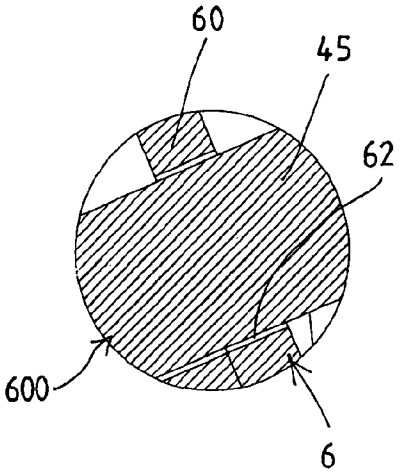
FIGS. 19, 20 are enlarged partial cross sectional views similar to FIGS. 17, 18 respectively, illustrating the operation of the patient treatment apparatus.
Figure 19:
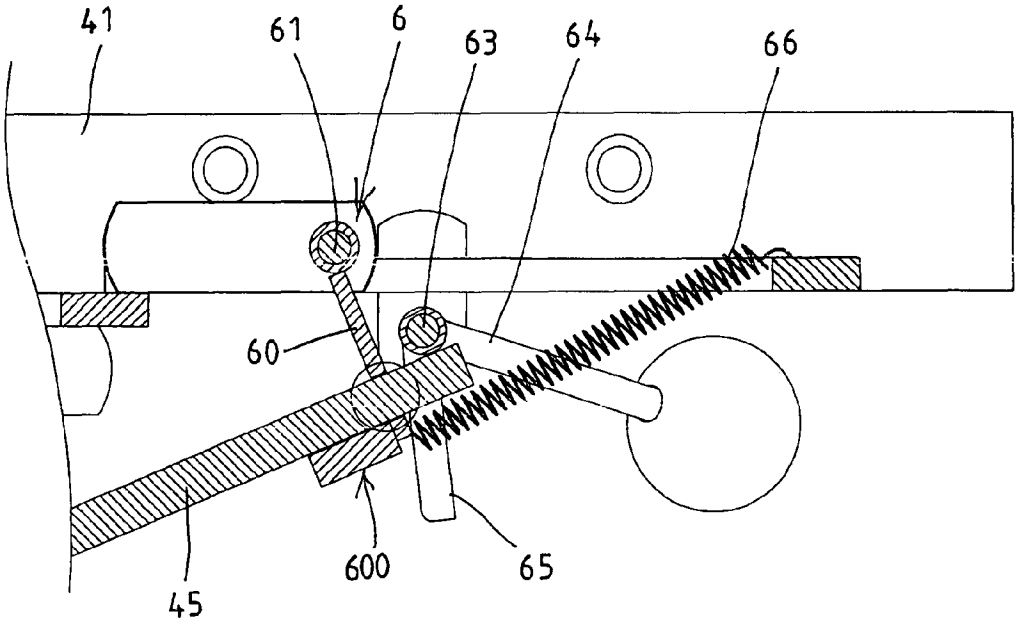
Figure 21:
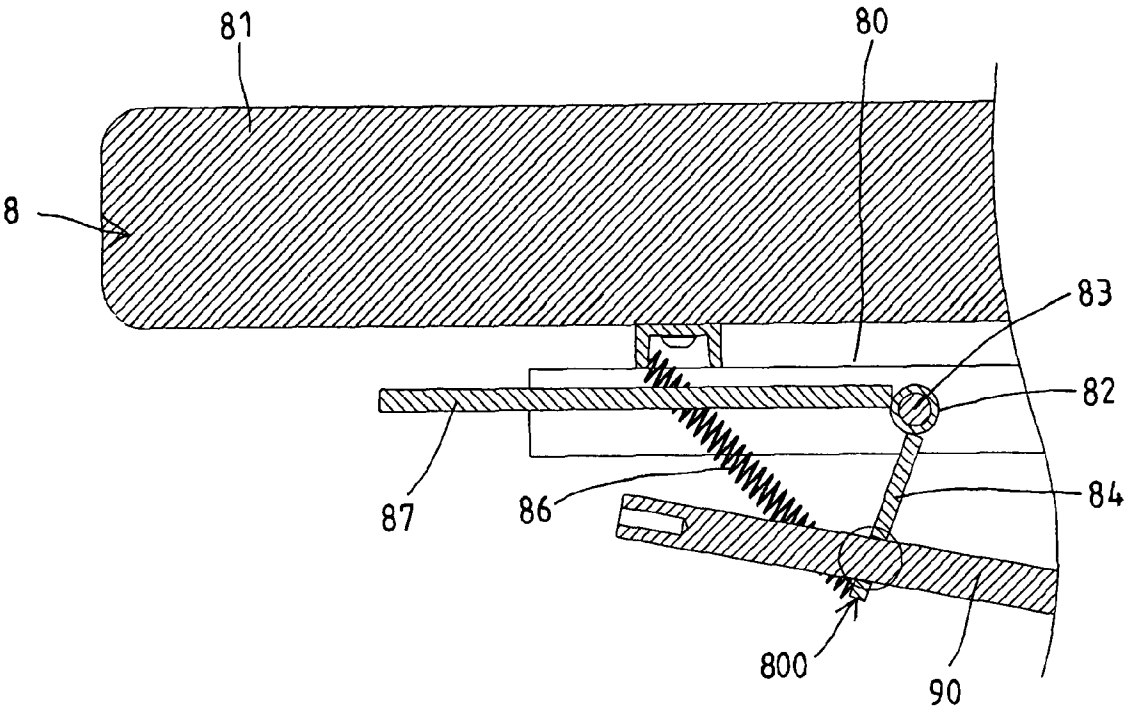
FIG. 21 is a still further enlarged partial cross sectional view of the patient treatment apparatus.
Figure 22:
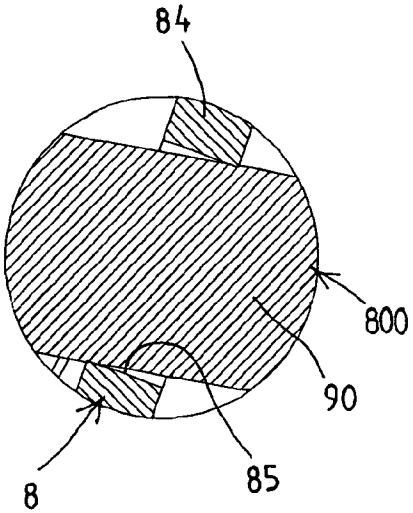
FIG. 22 is a still further enlarged partial cross sectional view of the patient treatment apparatus as shown in FIG. 21.
Figure 23:
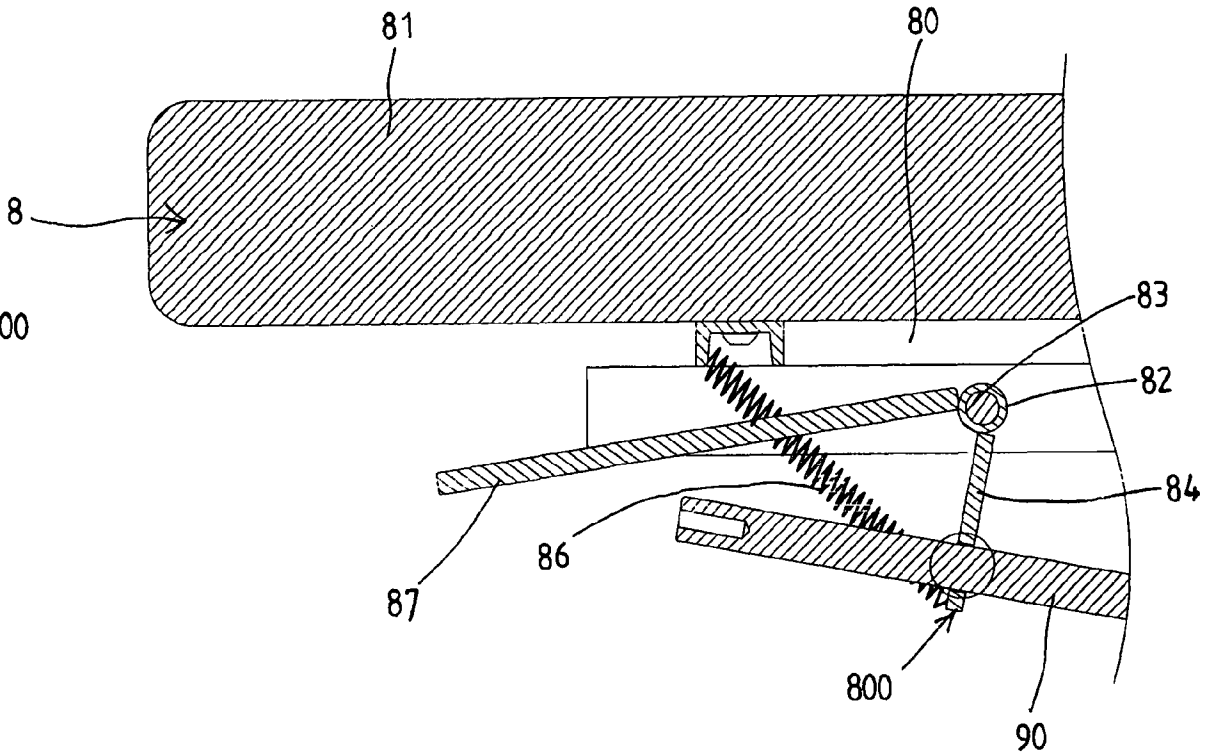
FIGS. 23, 24 are enlarged partial cross sectional views similar to FIGS. 21, 22 respectively, illustrating the operation of the patient treatment apparatus.
Figure 24:
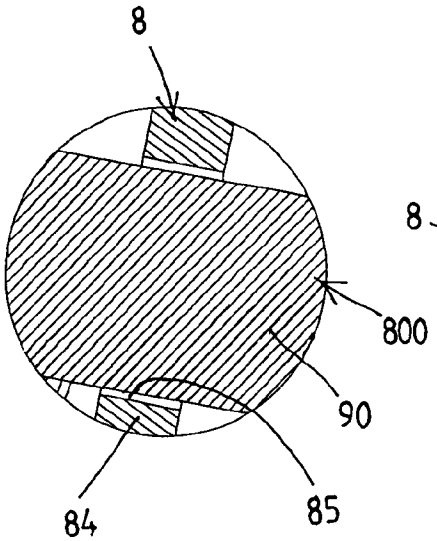

The spindles 67 may be rotated or threaded to the anchoring element 78 to engage with the anchor stick 76 (FIGS. 13-14) and to solidly secure the anchor stick 76 to the anchoring element 78 and thus to anchor or position the back support segment 7 to the auxiliary table segment 41 at the required angular position. On the contrary, as shown in FIGS. 15-16, the spindles 67 may also be rotated or threaded to the anchoring element 78 and to be disengaged from the anchor stick 76 and thus to allow the anchor stick 76 to slide or move relative to the anchoring element 78 and to adjust the back support segment 7 relative to the auxiliary table segment 41 to the required angular position.

A foot or leg support 8 may further be provided and includes a frame 80 pivotally or rotatably coupled to the primary table segment 40 with the pivot axle 24 for allowing the frame 80 of the leg support 8 to be pivoted or rotated up and down relative to the primary table segment 40 with the pivot axle 24, and includes one or more pads or cushions 48 disposed or attached or mounted on top of the frame 80 for comfortably supporting the lower or leg portion of the patient or the user thereon. A latch device 82 is pivotally or rotatably coupled or secured to the frame 80 of the leg support 8 with pivot pins 83, and includes an arm 84 extended outwardly therefrom and having an orifice 85 formed in the arm 84, and an anchor pole 90 is pivotally or rotatably coupled or secured to the primary table segment 40 with a pivot pin 91 and slidably received or engaged in the orifice 85 of the arm 84 as shown in FIGS. 7-12 and 21-24, for adjustably anchoring or positioning the frame 80 of the leg support 8 to the primary table segment 40 at the required angular position when the anchor pole 90 is tilted or inclined relative to the arm 84 of the latch device 82 relatively (FIGS. 7-12, and 21-22).

The latch device 82 further includes a spring member 86 provided and coupled between the frame 80 of the leg support 8 and the arm 84 of the latch device 82 for biasing and forcing and tilting the arm 84 of the latch device 82 relative to the anchor pole 90, and thus for anchoring or positioning the frame 80 of the leg support 8 to the primary table segment 40 at the required angular position, and further includes a knob or handle 87 extended outwardly from the latch device 82 for tilting or rotating the arm 84 of the latch device 82 relative to the anchor pole 90 and for aligning the anchor pole 90 with the orifice 85 of the arm 84 (FIGS. 23-24) and for disengaging the anchor pole 90 from the arm 84, and thus for allowing the frame 80 of the leg support 8 to be pivoted or rotated relative to the primary table segment 40 to the required angular position. The arm 84 of the latch device 82 and the anchor pole 90 may be formed and may act as a latch mechanism 800 and may be disposed or coupled between the frame 80 of the leg support 8 and the primary table segment 40 to adjustably anchor or position or latch or secure the leg support 8 to the primary table segment 40 at the required angular position.

The patient supporting table 4 may further include one or more pads or cushions 47 disposed or attached or mounted on top of the primary table segment 40 for comfortably supporting the buttock portion of the patient or the user thereon, and includes one or more further pads or cushions 48 disposed or attached or mounted on the back support segment 7 for comfortably supporting the back portion of the patient or the user thereon, and includes one or more further pads or cushions 49 (FIGS. 1, 3) disposed or attached or mounted on the side portions of the primary table segment 40 for engaging with the patient or the user and for preventing the patient or the user from falling down from the patient supporting table 4.

In operation, as shown in FIGS. 7-12 and 13-16, the spindles 67 may be rotated or threaded to the anchoring element 78 and may be disengaged from the anchor stick 76 to allow the anchor stick 76 to slide or move relative to the anchoring element 78 and to adjust the back support segment 7 relative to the auxiliary table segment 41 to the required angular position before the spindles 67 lock or latch or secure the anchor stick 76 to the anchoring element 78 again. As shown in FIGS. 7-12 and 17-20, the actuating members 65 of the shaft 63 may be rotated or operated to selectively engage with the anchor members 60 and to rotate the anchor members 60 relative to the anchor rods 45 respectively for selectively disengaging the anchor rods 45 from the anchor members 60 and for allowing the auxiliary table segment 41 to be pivoted or rotated relative to the primary table segment 40 to the required angular position before the hand grips 64 are released.

As shown in FIGS. 7-12 and 21-24, the arm 84 of the latch device 82 may be tilted or inclined relative to the anchor pole 90 with the handle 87 for disengaging the anchor pole 90 from the arm 84 and for allowing the frame 80 of the leg support 8 to be pivoted or rotated relative to the primary table segment 40 to the required angular position before the handle 87 is released. When the handle 87 is released, the spring member 86 may bias and force and tilt the arm 84 of the latch device 82 relative to the anchor pole 90 again in order to anchor or latch or secure or lock the anchor pole 90 to the arm 84 of the latch device 82 and the frame 80 of the leg support 8 and thus to anchor or position or lock the frame 80 of the leg support 8 to the primary table segment 40 to the required angular position.

As also shown in FIGS. 7-12, the cantilever members 20, 21 of the parallelogrammic device 2 and the patient supporting table 4 may be elevated or pivoted or rotated up and down relative to the platform 10 by the elevating transmission device 3 between the lower rest position (FIGS. 1-2, and 7-9) and the upper working position (FIGS. 10-12), and the patient supporting table 4 may be elevated or pivoted or rotated up and down relative to the parallelogrammic device 2 to the required angular position by the tilting transmission device 5.

Accordingly, the patient treatment apparatus in accordance with the present invention includes a stable support for stably elevating the patient supporting table and for allowing the patient supporting table to be tilted or inclined relative to the supporting base to suitably support the head or upper portion and the leg or lower portion of the patient tiltedly or inclinedly relative to the patient supporting table.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A patient treatment apparatus comprising:

a platform, a patient supporting table supported above said platform and including a primary table segment, an auxiliary table segment pivotally coupled to said primary table segment for allowing said auxiliary table segment to be pivoted and rotated relative to said primary table segment, and a back support segment pivotally coupled to said primary table segment and to be located above said auxiliary table segment, an anchor assembly disposed between said primary table segment and said auxiliary table segment to adjustably anchor and position said auxiliary table segment to said primary table segment at a selected angular position, said anchor assembly including an anchor rod pivotally attached to said primary table segment, and an anchor member pivotally coupled to said auxiliary table segment and engaged with said anchor rod for adjustably anchoring and positioning said auxiliary table segment to said primary table segment at the selected angular position, said anchor assembly including an actuating member pivotally attached to said auxiliary table segment for selectively engaging with said anchor member and for disengaging said anchor rod from said anchor member and for allowing said auxiliary table segment to be pivoted relative to said primary table segment to the selected angular position, and an anchoring mechanism disposed between said back support segment and said auxiliary table segment to adjustably anchor and position said back support segment to said auxiliary table segment at a required angular position.

2. The patient treatment apparatus as claimed in claim 1, wherein said anchor member includes an anchoring hole formed therein for slidably receiving and engaging with said anchor rod and for adjustably anchoring and positioning said auxiliary table segment to said primary table segment when said anchor rod is tilted relative to said anchor member.

3. The patient treatment apparatus as claimed in claim 1, wherein said actuating member is pivotally attached to said auxiliary table segment with a shaft, and a hand grip is extended from said shaft for rotating said shaft relative to said auxiliary table segment.

4. The patient treatment apparatus as claimed in claim 1, wherein said anchoring mechanism includes an anchor stick pivotally coupled to said back support segment, and an anchoring element pivotally coupled to said auxiliary table segment and engaged with said anchor stick for adjustably anchoring and positioning said back support segment to said auxiliary table segment.

5. The patient treatment apparatus as claimed in claim 4, wherein said anchoring element is pivotally attached to said auxiliary table segment with a pivot spindle and includes an aperture formed in said anchoring element for receiving and engaging with said anchor stick.

6. The patient treatment apparatus as claimed in claim 1, wherein said patient supporting table includes a frame pivotally coupled to said primary table segment, and a latch mechanism coupled between said frame and said primary table segment to adjustably anchor and position said frame to said primary table segment at a required angular position.

7. The patient treatment apparatus as claimed in claim 6, wherein said latch mechanism includes an anchor pole pivotally coupled to the primary table segment, and a latch device pivotally coupled to the frame and engaged with said anchor pole for adjustably anchoring and positioning said frame to said primary table segment at the required angular position.

8. The patient treatment apparatus as claimed in claim 7, wherein said latch device includes an arm, and an orifice formed in said arm for slidably receiving and engaging with said anchor pole, and a handle extended from said latch device for tilting said arm of said latch device relative to said anchor pole.

9. The patient treatment apparatus as claimed in claim 1, wherein said platform includes an upper cantilever member and a lower cantilever member pivotally attached and coupled to said platform with pivot poles, and a bracket pivotally attached and coupled to said upper and said lower cantilever members with pivot axles respectively for allowing said upper and said lower cantilever members and said bracket to be formed as a parallelogrammic device and for allowing said upper and said lower cantilever members to be pivoted up and down relative to said platform with said pivot poles, and an elevating transmission device including a tube, and a motor-driven rod slidably received and engaged in said tube and coupled between said platform and said parallelogrammic device for pivoting said upper and said lower cantilever members up and down relative to said platform.

10. The patient treatment apparatus as claimed in claim 9, wherein said elevating transmission device includes a seat having a lower portion pivotally attached and coupled to said platform with a pivot pin, and said tube is extended upwardly from said seat and said rod is slidably received and engaged in said tube and coupled to said parallelogrammic device.

11. The patient treatment apparatus as claimed in claim 10, wherein said parallelogrammic device includes a lateral bar attached to said upper cantilever member for supporting said pivot pin, and said lateral bar includes an upwardly bent structure for supporting said pivot pin above said upper cantilever member.

12. A patient treatment apparatus comprising:

a platform, a patient supporting table supported above said platform and including a primary table segment, an auxiliary table segment pivotally coupled to said primary table segment for allowing said auxiliary table segment to be pivoted and rotated relative to said primary table segment, and a back support segment pivotally coupled to said primary table segment and to be located above said auxiliary table segment, an anchor assembly disposed between said primary table segment and said auxiliary table segment to adjustably anchor and position said auxiliary table segment to said primary table segment at a selected angular position, said anchor assembly including an anchor rod pivotally attached to said primary table segment, and an anchor member pivotally coupled to said auxiliary table segment and engaged with said anchor rod for adjustably anchoring and positioning said auxiliary table segment to said primary table segment at the selected angular position, said anchor assembly including a spring member coupled between said anchor member and said auxiliary table segment for biasing and tilting said anchor member relative to said anchor rod, and an anchoring mechanism disposed between said back support segment and said auxiliary table segment to adjustably anchor and position said back support segment to said auxiliary table segment at a required angular position.

13. A patient treatment apparatus comprising:

a platform, a patient supporting table supported above said platform and including a primary table segment, an auxiliary table segment pivotally coupled to said primary table segment for allowing said auxiliary table segment to be pivoted and rotated relative to said primary table segment, and a back support segment pivotally coupled to said primary table segment and to be located above said auxiliary table segment, an anchor assembly disposed between said primary table segment and said auxiliar table segment to adjustably anchor and position said auxiliary table segment to said primary table segment at a selected angular position, and an anchoring mechanism disposed between said back support segment and said auxiliary table segment to adjustably anchor and position said back support segment to said auxiliary table segment at a required angular position, said anchoring mechanism including an anchor stick pivotally coupled to said back support segment, and an anchoring element pivotally coupled to said auxiliary table segment and engaged with said anchor stick for adjustably anchoring and positioning said back support segment to said auxiliary table segment, said anchoring element being pivotally attached to said auxiliary table segment with a pivot spindle and including an aperture formed in said anchoring element for receiving and engaging with said anchor stick, and said pivot spindle including a threading element for engaging with said anchoring element and for selectively engaging with said anchor stick and for selectively securing said anchor stick to said anchoring element.

14. A patient treatment apparatus comprising:

a platform, a patient supporting table supported above said platform and including a primary table segment, an auxiliary table segment pivotally coupled to said primary table segment for allowing said auxiliary table segment to be pivoted and rotated relative to said primary table segment, and a back support segment pivotally coupled to said primary table segment and to be located above said auxiliary table segment, said patient supporting table including a frame pivotally coupled to said primary table segment, and a latch mechanism coupled between said frame and said primary table segment to adjustably anchor and position said frame to said primary table segment at a required angular position, said latch mechanism including an anchor pole pivotally coupled to the primary table segment, and a latch device pivotally coupled to the frame and engaged with said anchor pole for adjustably anchoring and positioning said frame to said primary table segment at the required angular position, said latch mechanism including a spring member coupled between said frame and said latch device for biasing and tilting said latch device relative to said anchor pole, an anchor assembly disposed between said primary table segment and said auxiliary table segment to adjustably anchor and position said auxiliary table segment to said primary table segment at a selected angular position, and an anchoring mechanism disposed between said back support segment and said auxiliary table segment to adjustably anchor and position said back support segment to said auxiliary table segment at a required angular position.

15. A patient treatment apparatus comprising:

a platform including an upper cantilever member and a lower cantilever member pivotally attached and coupled to said platform with pivot poles, and a bracket pivotally attached and coupled to said upper and said lower cantilever members with pivot axles respectively for allowing said upper and said lower cantilever members and said bracket to be formed as a parallelogrammic device and for allowing said upper and said lower cantilever members to be pivoted up and down relative to said platform with said pivot poles, an elevating transmission device including a tube, and a motor-driven rod slidably received and engaged in said tube and coupled between said platform and said parallelogrammic device for pivoting said upper and said lower cantilever members up and down relative to said platform, said parallelogrammic device including a tilting transmission device having a tube, and a motor-driven rod slidably received and engaged in said tube and coupled between said patient supporting table and said parallelogrammic device for tilting said patient supporting table between a horizontal position and a tilted working position, a patient supporting table supported above said platform and including a primary table segment, an auxiliary table segment pivotally coupled to said primary table segment for allowing said auxiliary table segment to be pivoted and rotated relative to said primary table segment, and a back support segment pivotally coupled to said primary table segment and to be located above said auxiliary table segment, an anchor assembly disposed between said primary table segment and said auxiliary table segment to adjustably anchor and position said auxiliary table segment to said primary table segment at a selected angular position, and an anchoring mechanism disposed between said back support segment and said auxiliary table segment to adjustably anchor and position said back support segment to said auxiliary table segment at a required angular position.

16. The patient treatment apparatus as claimed in claim 15, wherein said tilting transmission device includes a seat having a lower portion pivotally attached and coupled to said bracket with a pivot pin, and said tube is extended upwardly from said seat and said rod is slidably received and engaged in said tube and coupled to said patient supporting table.

* * * * *